US011666197B2

(12) United States Patent
Poirier

(10) Patent No.: US 11,666,197 B2
(45) Date of Patent: Jun. 6, 2023

(54) HOSE ACCESSORY

(71) Applicant: Roemar, Inc., Southborough, MA (US)

(72) Inventor: Robert Poirier, Southborough, MA (US)

(73) Assignee: Roemar, Inc., Southborough, MA (US)

( * ) Notice: Subject to any disclaimer, the term of this patent is extended or adjusted under 35 U.S.C. 154(b) by 894 days.

(21) Appl. No.: 16/522,109

(22) Filed: Jul. 25, 2019

(65) Prior Publication Data

US 2020/0154972 A1 May 21, 2020

Related U.S. Application Data

(60) Provisional application No. 62/703,541, filed on Jul. 26, 2018.

(51) Int. Cl.
*A47L 13/26* (2006.01)
*A47L 13/23* (2006.01)

(52) U.S. Cl.
CPC ..... *A47L 13/26* (2013.01); *A47L 13/23* (2013.01)

(58) Field of Classification Search
CPC ..... A47L 13/23; A47L 13/26; A46B 11/063
See application file for complete search history.

(56) References Cited

U.S. PATENT DOCUMENTS 5,336,012 A * 8/1994 Newville ..... A46B 11/063 403/109.5
5,487,529 A * 1/1996 Newville ..... A46B 11/063 403/109.5
5,584,594 A * 12/1996 Newville ..... A46B 11/063 285/302
7,959,191 B2 * 6/2011 Schouten ..... A47L 13/23 285/298
8,568,051 B2 * 10/2013 Burnett ..... A46B 11/066 401/289
9,241,560 B1 * 1/2016 Angel ..... A46B 17/02
2007/0011843 A1 1/2007 Battle et al.

FOREIGN PATENT DOCUMENTS

CH 648191 A * 3/1985 ..... A46B 11/063
CN 204176204 U 2/2015
WO WO 96/24000 A1 8/1996

* cited by examiner

*Primary Examiner* — Jennifer C Chiang
(74) *Attorney, Agent, or Firm* — Wolf, Greenfield & Sacks, P.C.

(57) ABSTRACT

A hose accessory includes a handle, a shaft slidably received in the handle, and a flexible conduit located within handle and shaft. The flexible conduit may be arranged to carry fluids between a first end of the hose accessory and a second end of the hose accessory. A lock is provided to secure the shaft in a fixed position relative to the handle. The lock may include a locking pin biased towards a locked position. The shaft may include first and second channels. The first channel receives at least a portion of the locking pin when the locking pin is in a locked position. The conduit extends through the second channel that isolates and separates the conduit from the locking pin.

20 Claims, 7 Drawing Sheets

HOSE ACCESSORY

CROSS-REFERENCE TO RELATED APPLICATIONS

This application claims the benefit under 35 U.S.C. § 119(e) of U.S. Provisional Application Ser. No. 62/703,541, entitled "HOSE ACCESSORY" and filed Jul. 26, 2018, which is herein incorporated by reference in its entirety.

FIELD

Embodiments disclosed herein relate to hose accessories.

BACKGROUND

Hoses are used to carry fluids from a fluid supply to a desired location, such as to a lawn being watered or a car being washed. Hose accessories are attachable to a hose to assist with distributing fluids or to assist with cleaning. For example, a sprayer, washer, wand, or mop brush may be attachable to a hose.

SUMMARY

According to one embodiment, a hose accessory is disclosed. The hose accessory includes a handle, a shaft slidably received in the handle, the shaft having first and second channels extending a long at least a portion of a length of the shaft, a flexible conduit located within the handle and shaft, the conduit adapted to carry fluid between a first end of the hose accessory and a second end of the hose accessory, and a lock adapted to secure the shaft in a fixed position relative to the handle, the lock including a moveable pin biased towards a locked position. The first channel is adapted to receive at least a portion of the moveable pin when the moveable pin is in the locked position.

According to another embodiment, a hose accessory is disclosed. The hose accessory includes a handle, a shaft slidably received in the handle, and a flexible fluid conduit located within the handle and shaft, the conduit extending continuously between a proximal end of the hose accessory and a distal end of the hose accessory. The first end of the flexible conduit is attached to the shaft and a second end of the flexible conduit is attached to the handle.

According to still another embodiment, a method of adjusting a length of a hose accessory is disclosed. The hose accessory includes a handle, a shaft slidably received in the handle, and a flexible conduit located within the shaft and handle, the flexible conduit configured to carry fluid from a proximal end of the hose accessory to a distal end of the hose accessory. The method includes slidably moving the shaft and handle relative to each other to adjust the accessory to a desired length, the shaft including first and second channels and a plurality of openings formed in a wall of the shaft, the plurality of openings being in communication with the first channel, and engaging one of the plurality of openings with a locking pin to secure the shaft in a fixed position relative to the handle at the desired length, the at least a portion of the locking pin extending into the first channel when the locking pin is engaged with the one of the plurality of openings.

According to yet another embodiment, a water brush hose accessory includes a handle, a shaft slidably received in the handle, the shaft having first and second channels extending a long at least a portion of a length of the shaft, a cleaning head located at a distal end of the shaft, a flexible conduit located within the handle and shaft, the conduit adapted to carry fluid between a proximal end of the hose accessory and the cleaning head, and a locking pin adapted to secure the shaft in a fixed position relative to the handle. The locking pin is biased towards a locked position. The first channel is adapted to receive at least a portion of the locking pin when the locking pin is in the locked position.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
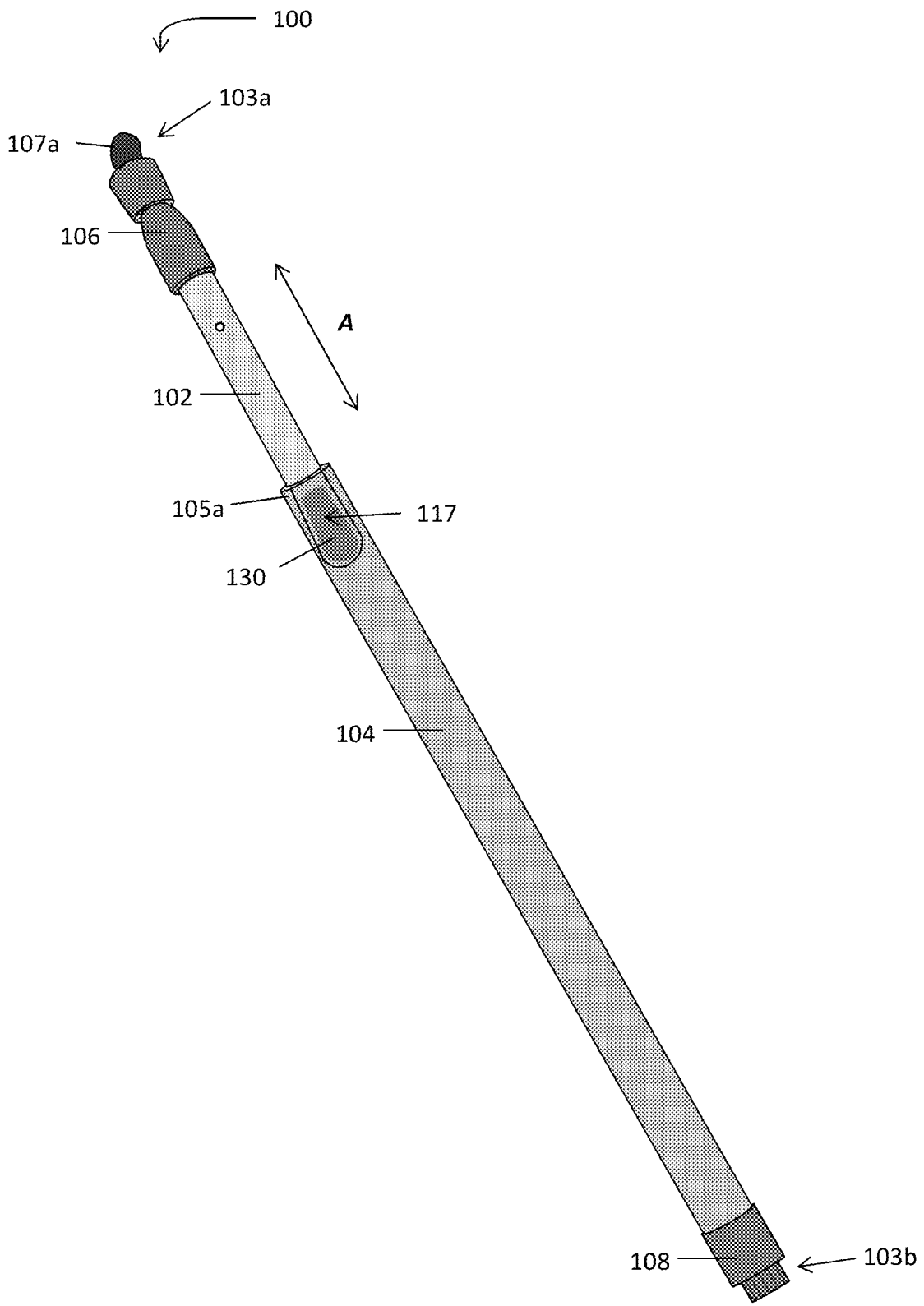
FIG. 1 is a perspective view of a hose accessory according to embodiments disclosed herein.

Hoses are used to carry fluids from a fluid supply to a desired location, such as to a lawn being watered or a car being washed. Hose accessories are attachable to a hose to assist with distributing the fluid or to assist with cleaning a surface. For example, a user may attach a mop or brush to the hose to wash the user's car. In some instances, a user may wish to direct water to or across a surface that is not located near or is not easily accessible by the user. For example, a user may want to clean the gutters of his house or wash the roof his car. In such an example, the user may use a hose accessory with a wand that can position the hose accessory closer to the location to be supplied with water. Some known hose accessories include a wand that is adjustable to allow the user to set the desired length of the hose accessory. However, such known apparatuses do no always provide a satisfactory solution in all aspects.

Applicant has recognized that advantages may be realized by having a rigid, adjustable hose accessory with a flexible conduit that extends within the hose accessory to carry fluid through the hose accessory. For example, water may flow through the flexible conduit from a first or proximal end of the hose accessory connected to a water supply (e.g. a water hose) to a second or distal end of the hose accessory connected to a cleaning head to distribute water and/or clean a surface. For purposes herein, the proximal end of the hose accessory includes the end of the hose accessory closest to a user when the user is holding the hose accessory to distribute fluid and/or clean a surface, with the cleaning head positioned away from the user and at or near the surface to be washed and/or cleaned.

In some embodiments, the hose accessory may include a handle and a shaft that may be moveably received in the handle. In such embodiments, the flexible conduit may be located within the handle and shaft. In some embodiments, the shaft may telescope relative to the handle to adjust a length of the hose accessory. In such embodiments, the flexible conduit may remain attached to the distal and proximal ends of the hose accessory as the shaft and handle move relative to one another. In some embodiments, the flexible conduit may be attached to a distal end of the shaft and a proximal end of the handle. In some embodiments, the distal end of the shaft may be located at or near the distal end of the hose accessory and the proximal end of the handle may be located at or near the proximal end of the hose accessory.

In some embodiments, the handle and shaft may be slidable relative to one another to change a length of the hose accessory. For example, the shaft may be moved away from or towards the handle to increase or decrease the length of the hose accessory. In such an example, the shaft may be extended from the handle or be retracted into the handle to adjust the length of the hose accessory. In some embodiments, the hose accessory may include a lock to maintain a position of the shaft relative to the handle to provide a desired fixed length of the hose accessory. In some embodiments, the lock may include a locking pin that may be spring-loaded. In some embodiments, the locking pin may be biased to a locked position. In some embodiments, the flexible inner conduit may facilitate retraction of the shaft towards the handle.

Applicant has also recognized that advantages may be realized by shielding the flexible inner conduit from the lock. Without wishing to be bound by theory, in embodiments in which the lock includes a locking pin, the flexible conduit may potentially become damaged or even tear from repeated contact between the flexible conduit and the locking pin. For example, the locking pin could puncture the conduit and/or could abrade and wear down a thickness of a portion of a wall of the conduit, making the portion of the conduit's wall fracturable. In some embodiments, the flexible conduit may be especially vulnerable to damage when the flexible conduit is stretched, such as when the length of the hose accessory has been increased or when the conduit is pressurized by fluid flowing through the conduit. In some embodiments, the shaft may include first and second channels arranged to accommodate the locking pin and the flexible conduit. For example, at least a portion of the locking pin may be received in the first channel when the locking pin is in the locked position. In such an example, the flexible conduit may be located within the second channel. The first and second channels may extend along at least a portion of a length of the shaft.

In view of the above, embodiments disclosed herein include a hose accessory with a handle, a shaft received in and slidable relative to the handle, and a flexible conduit located within the handle and shaft for carrying fluid through the hose accessory. In some embodiments, the handle and shaft may move relative to one another to adjust a length of the hose accessory. In some embodiments, the hose accessory may include a lock to maintain a fixed position of the shaft relative to the handle. In some embodiments, the lock may include a locking pin that extends inwardly into the shaft and/or handle. In some embodiments, the shaft may include first and second channels arranged to shield the flexible conduit from the lock. In such embodiments, the first channel may be arranged to receive the locking pin and the second channel may be arranged to receive the conduit.

Figure 2A:
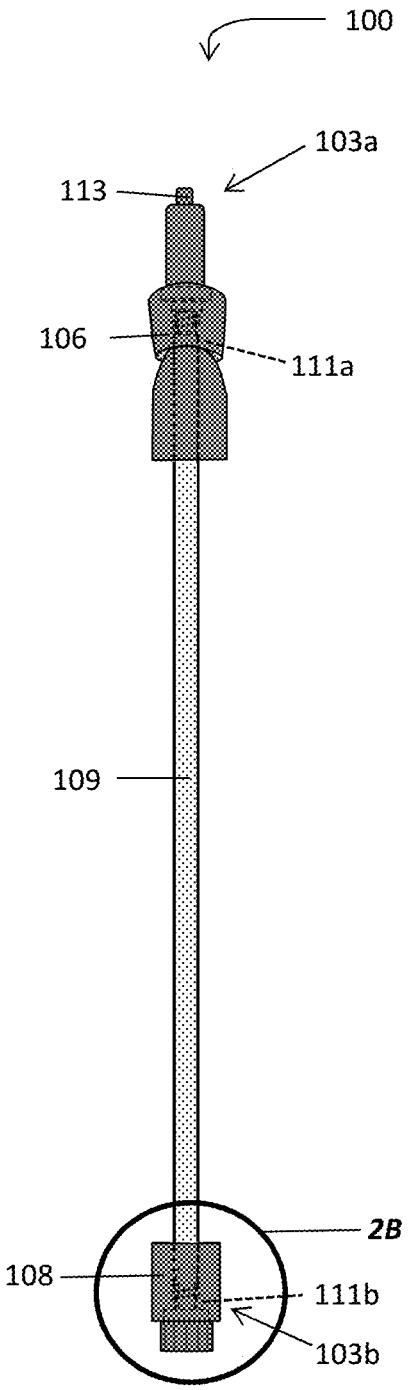
FIG. 2A is view of an inner conduit and connectors of the hose accessory of FIG. 1.
Figure 2B:
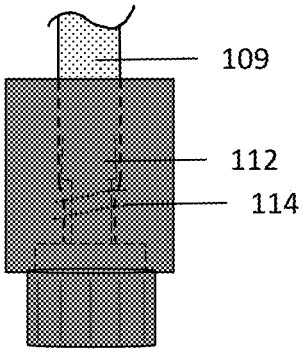
FIG. 2B is an enlarged view of the second connector and inner conduit shown in the circle labeled 2B in FIG. 2A.
Figure 3:
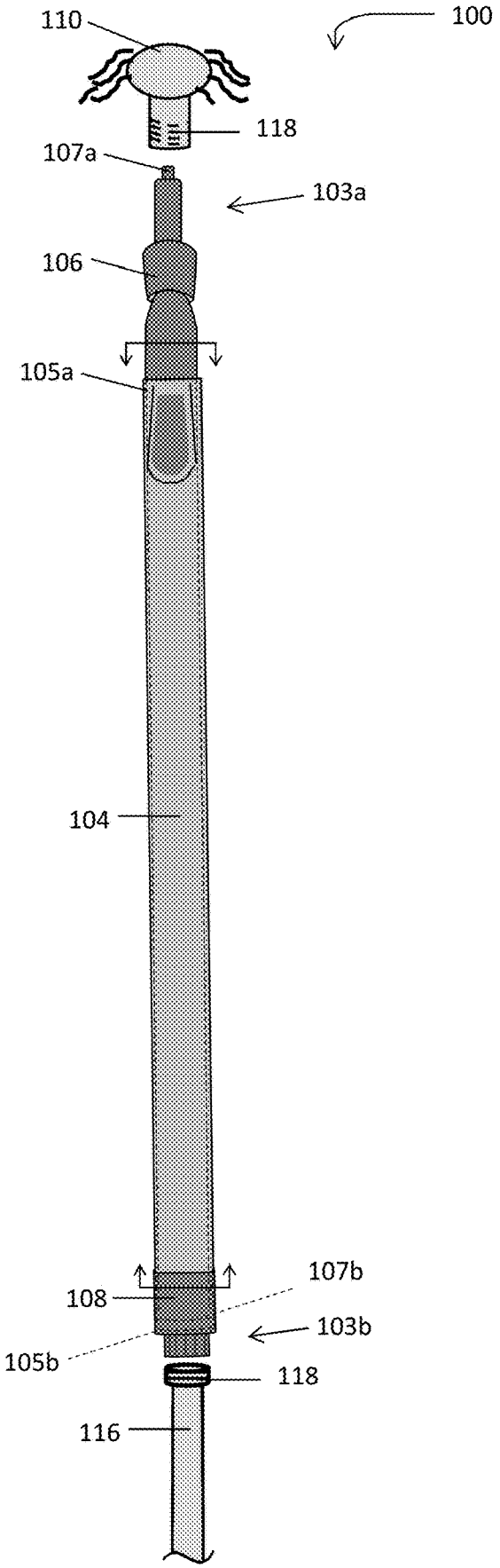
FIG. 3 is a front view of the hose accessory of FIG. 1, attachable to a fluid supply and a cleaning head.

Turning now to the figures, FIGS. 1-3 show a hose accessory according to embodiments of the present disclosure. As shown, the hose accessory 100 may include a handle 104 and a shaft 102, the shaft 102 being at least partially received in the handle 104. For purposes herein, the shaft may include a pole, rod, tube, stick, or other suitable structure. In some embodiments, the shaft may be longer than the handle, with at least a portion of the shaft extending outwardly beyond a distal end 105*a* of the handle. The hose accessory also may include an inner conduit 109 that extends between the distal end 103*a* and proximal end 103*b* of the hose accessory for carrying fluid through the hose accessory. In some embodiments, the conduit extends continuously between the distal and proximal ends of the hose accessory.

In some embodiments, the shaft 102 may be slidably received in the handle 104, with the shaft and handle being moveable relative to one another. In such embodiments, the shaft and handle may be moveable relative to one another to adjust a length of the hose accessory 100. For example, as shown in FIG. 1, in an extended position, the distal end 107*a* of the shaft may be moved away from the distal end 105*a* of the handle (see arrow A). As will be described, a lock 117 may be used to hold and fix the position of the shaft relative to the position of the handle in this extended position.

FIG. 3 illustrates the hose accessory retracted to a shorter length as compared to FIG. 1. In some embodiments, to shorten the length of the hose accessory, the shaft may be retracted into the handle (see arrow A in FIG. 1). In such embodiments, the distal end 107*a* of the shaft may be moveable towards the distal end 105*a* of the handle. For example, as shown in FIG. 3, in the shortened position, the proximal end of the shaft 107*b* may be positioned adjacent to the proximal end 105*b* of the handle. Also in this position, the distal end 107*a* of the shaft may be adjacent to the distal end 105*a* of the handle.

Figure 7:
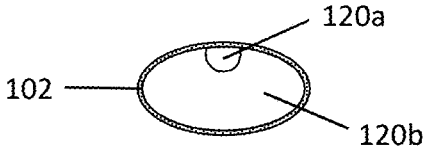
FIG. 7 is a cross-sectional view of the shaft of FIG. 6, along line 7-7.
Figure 8A:
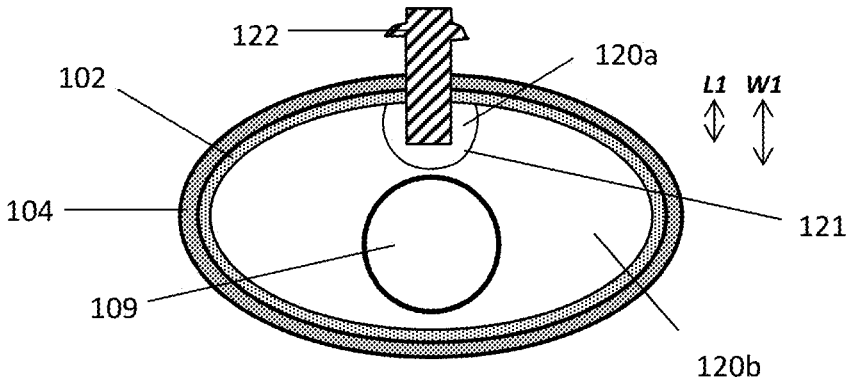
FIGS. 8A and 8B illustrate shielding of an inner conduit of a hose accessory using first and second channels of a shaft. The inner conduit is shown in a relaxed state in FIG. 8A and when fluid is passing through the inner conduit in FIG. 8B.
Figure 8B:
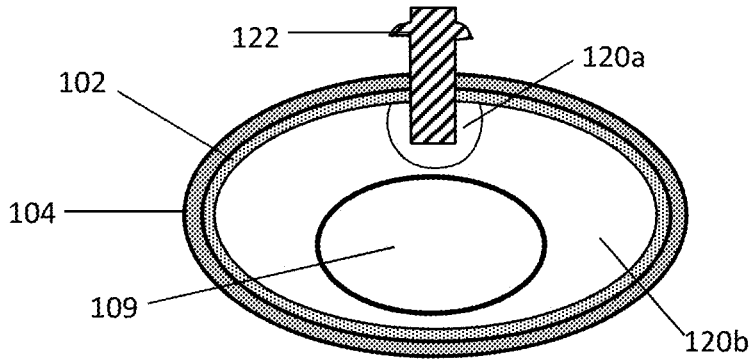

The handle and shaft may be configured with an oval cross-sectional shape (see, e.g., FIGS. 7 and 8A-8B). The handle and shaft also may have other suitable shapes. For example, and without limitation, the handle and shaft also may have a substantially cylindrical, triangular, square, other polygonal, or other suitable cross-sectional shape. As will be appreciated, the cross-sectional shapes of the handle and shaft may be substantially the same in some embodiments such that the shaft may be moveable relative to the handle. As will be appreciated, the hose accessory may have other suitable arrangements with the cross sectional shape of the handle being different than that of the shaft.

In some embodiments, the inner conduit may be made of a flexible and stretchable material. For example, the inner conduit may be made of an elastic material. In some embodiments, such a stretchable and flexible inner conduit may facilitate retraction of the shaft into the handle. In such embodiments, extending the shaft from the handle may stretch and load the flexible conduit. As will be appreciated, when the shaft is released, the preload of the flexible conduit may encourage retraction of the shaft into the handle. For example, the shaft may be drawn towards the handle such that the shaft is retractable into the handle (e.g., for a shorter length hose accessory) when the lock is disengaged and the user releases the shaft.

In some embodiments, a first end 111*a* of the inner conduit 109 may be attached to the shaft and a second end 111*b* of the inner conduit may be attached to the handle 104. For example, the first end 111*a* of the inner conduit may be attached to the distal end 107*a* of the shaft 102 while the second end 111*b* of the inner conduit 109 may be attached to the proximal end 107*b* of the handle 104.

As shown in FIGS. 1-3, the hose accessory may include one or more connectors arranged to attach the hose accessory to a hose and/or to a cleaning head. For example, as shown in FIGS. 1 and 3, a first connector 106 may be located at a distal end 107*a* of the shaft 102 and a second connector 108 may be located at a proximal end 105*b* of the handle. In some embodiments, the connectors may be configured to receive the respective ends of the handle and shaft. In this regard, the shape and size of the connectors may correspond to the cross-sectional shape and size of the end of the handle and shaft. In some embodiments, the connectors may be located at or near the respective ends of the hose accessory.

In some embodiments, as shown in FIGS. 2A-2B, the first and second connectors also may be arranged to connect the inner conduit 109 to the respective handle and shaft. For example, each of the first and second connectors may include an inwardly-protruding coupler 112 connected to an end of the conduit. In some embodiments, the coupler may include a flange. In some embodiments, each coupler may be configured to be inserted into one of the ends of the conduit. In such embodiments, the end of the conduit may be crimped, tied or otherwise secured to the coupler of the connector. In one embodiment, as shown in FIG. 2B, the conduit 109 may be secured to the coupler 112 using a wire 114 that is tightly wrapped around the conduit.

As will be appreciated, the connectors may be attached to the ends of the handle and shaft using any suitable method. For example, the connectors may be attached using an adhesive, a screw or other suitable fastener, or other suitable methods. As will be further appreciated, the connectors may include other suitable arrangements. For example, instead of receiving the ends of the handle and shaft, the connectors may be configured to be inserted into the respective ends of the handle and shaft. The connectors also may be press fit or snap fit onto the respective ends of the handle and shaft. In still other embodiments, the connectors may be integrally formed with the handle and shaft.

In some embodiments, the hose accessory may be configured to receive fluid at the second connector 108. In such embodiments, fluid may flow through the coupler, into and through the conduit, and exit the hose accessory at the first connector 106. In some embodiments, as illustrated in FIG. 2A, the first connector 106 may include a nozzle 113 from which the fluid may exit the hose accessory. In some embodiments, such as that shown in FIG. 3, when a cleaning head 110 is attached to the hose accessory fluid may exit the hose accessory through the cleaning head. For example, as shown in FIG. 3, fluid may exit the hose accessory from a scrub brush attached to the hose accessory. In some embodiments, fluid may flow through the nozzle 113 of the first connector and into and out of the cleaning head. As will be appreciated, fluid flowing between the proximal and distal ends of the hose accessory may travel through the inner conduit and not contact the handle or shaft.

Figure 4A:
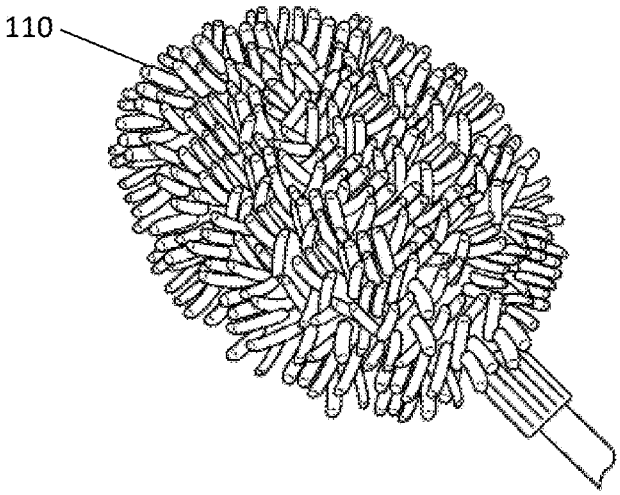
FIGS. 4A-4C illustrates examples of cleaning heads that are attachable to a hose accessory of the present disclosure.
Figure 4B:
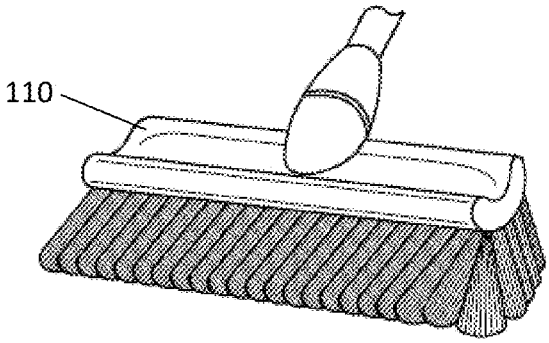
Figure 4C:
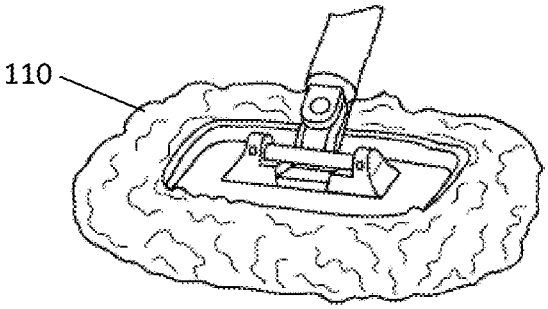

In some embodiments, each of the first and second connectors may include a threaded connection for attaching a water supply and/or a cleaning head. For example, as shown in FIG. 3, a first end of a garden hose 116, which may be connected to a water supply, may have threads 118 that engage with corresponding threads on the connector 108. In a similar manner, the cleaning head 110, such as a scrub brush, may include threads 118 that engage with corresponding threads on the first connector 106. As will be appreciated, although threaded connections are shown for attaching the water supply and/or cleaning head to the hose accessory 100, other attachment mechanisms may be used. For example, the water supply and/or cleaning head may be press fit, snap fit, or otherwise removably attached to the hose accessory. As will be further appreciated, although a scrub brush is shown as being attachable to the hose accessory in FIG. 3, the hose accessory may be attached to other cleaning heads, such as washers, brushes, sprayers, and mops. FIGS. 4A-4C show illustrative examples of cleaning heads 110 that are attachable to the hose accessory of the present disclosure.

In some embodiments, the cleaning head may be removably attachable to the first connector, such as that shown in FIG. 3. As will be appreciated, in other embodiments, the accessory head may be fixedly attached or even integrally formed with the first connector. The accessory head also may be fixedly attached or even integrally formed with the shaft.

According to another aspect of the present disclosure, the hose accessory may be arranged to shield the inner conduit from the lock. As will be appreciated, although embodiments are shown and described for shielding the inner conduit from the lock, the disclosed methods also may be used to shield the inner conduit from other portions of the hose accessory. The disclosed embodiments also may be used for shielding other portions of the hose accessory from the lock.

Figure 5A:
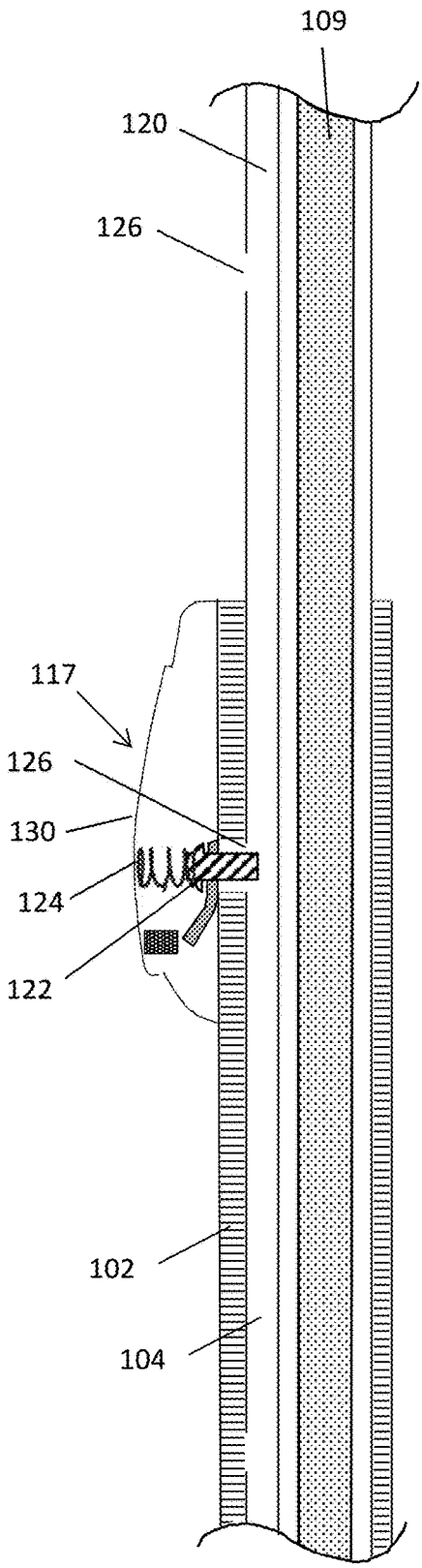
FIGS. 5A and 5B illustrate a method by which a length of a hose accessory may be adjusted.
Figure 5B:
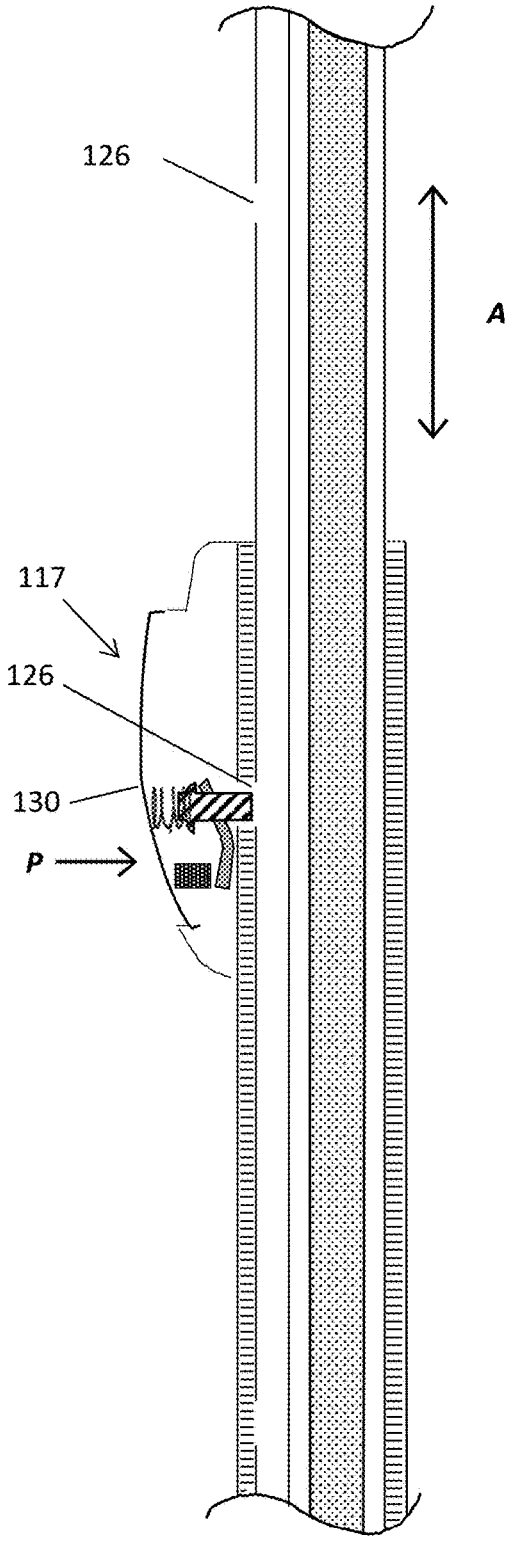

As shown in FIGS. 5A and 5B, the lock 117 may be used to maintain the relative positions of the shaft and handle to allow the user to set the desired length of the hose accessory. As will be appreciated, in such embodiments, the lock may secure a fixed position of the shaft relative to the handle. In some embodiments, the lock may include a locking pin 122, such as a spring pin, which may be biased to a locked position via a spring 124. In the locked position, as shown in FIG. 5A, the locking pin 122 may engage an opening 126 formed in a wall of the shaft (see also FIG. 6), with the distal end of the locking pin 122 projecting through the opening in the wall and into the shaft.

Figure 6:
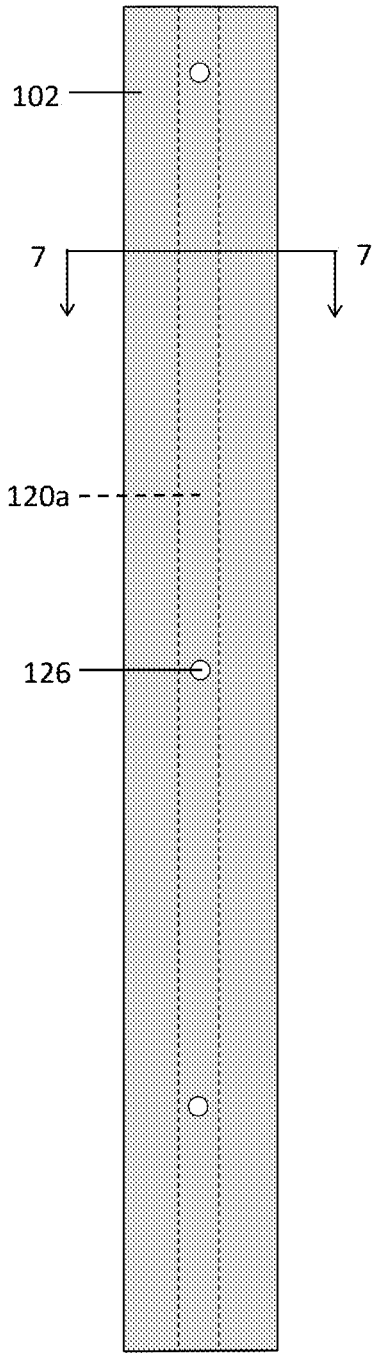
FIG. 6 is an enlarged front view of a shaft of a hose accessory according to embodiments disclosed herein.

In some embodiments, as show in FIG. 6, the shaft may include multiple openings formed in a wall of the shaft. In such embodiments, a first opening may be spaced apart from an adjacent opening formed in the shaft wall. In some embodiments, the openings may be spaced between about 3 inches and about 9 inches from one another, although the openings may be spaced other suitable distances from one another. As will be appreciated, a distance between adjacent openings may be the same in some embodiments, although the distance between adjacent openings may vary. For example, an opening may be spaced 9 inches from a first adjacent opening and 3 inches from a second adjacent opening.

In some embodiments, the user may increase a length of the hose accessory by a length equal to a distance between a first opening the locking pin is engaged with and a second opening into which the locking pin is being moved. For example, the length of the hose accessory may increase by between about 9 inches when the pin is moved from a first opening to a second, adjacent opening.

In some embodiments, the openings may be aligned along a length of the shaft. For example, as shown in FIG. 6, the openings may be longitudinally aligned along the length of the shaft. As will be appreciated, although the shaft is shown as having three openings in FIG. 6, the shaft may have more or fewer openings, as this aspect of the disclosure is not limited in this regard. As will be further appreciated, although openings are arranged along an entire length of the shaft in FIG. 6, the openings may be arranged along only a portion of the length of the shaft.

As shown in FIGS. 5A-5B, 6-7, and 8A-8B, the shaft 102 may include first and second channels 120*a*, 120*b* configured to separate and isolate the inner conduit 109 from the locking pin 122. In some embodiments, the first and second channels 120*a*, 120*b* extend along at least a portion of the length of the shaft. In some embodiments, as shown in FIGS. 8A and 8B, the first channel may be arranged to receive the locking pin while the inner conduit 109 extends through the second channel. In this regard, the locking pin does not contact the inner conduit 109. As shown in FIG. 8B, even if the fluid travelling through the inner conduit causes the inner conduit to expand radially and/or change shape, the locking pin still may be located in the first channel and may not contact the inner conduit.

As shown in FIG. 7, in one embodiment, the first channel 120*a* may include a substantially semicircular cross-sectional shape. In such an embodiment, the first channel is inwardly directed towards a center of the shaft. As will be appreciated, the first channel may include other suitable cross-sectional shapes, such as square, rectangle, oval, triangular, other polygonal, or other shapes. As will be further appreciated, the relative sizes of the first and second channels may vary in other embodiments.

As shown in FIGS. 8A and 8B, the first channel 120*a* may be configured to receive at least a portion of the locking pin 122. For example, as shown in FIG. 8A, a width of the first channel W1 is greater than a length L1 of the locking pin 122 that extends into the shaft when the locking pin is in the locked position. As will be appreciated, the width W1 of the channel also may be the same size or even smaller than the length of the locking pin protruding into the shaft. In such embodiments, an inner wall of the first channel may be configured to limit travel of the locking pin into the shaft.

Although the first and second channels of the shaft are shown as extending along the entire length of the shaft, in other embodiments, the first and second channels may extend along on a portion of the shaft. For example, the first channel may extend along only half of the length of the shaft. As will be appreciated, in such an example, the first channel may extend along only the portions of the shaft where the openings arranged to receive the locking pin are located. In some embodiments, the openings may be located on a portion of the shaft opposite to the location of the first channel. In such embodiments, the openings may be in communication with the first channel. As will be appreciated, in embodiments in which the first channel extends along only a portion of the shaft, the remainder of the length of the shaft may include only the second channel (e.g., may include only a single channel).

Although the shaft is shown as having a channel wall 121 separating the first and second channels (see FIG. 8A), in other embodiments, the first and second channels may be in communication with one another. In such embodiments, an opening (or multiple openings) in the channel wall may be small or narrow enough such that the flexible conduit may not pass into the channel configured to receive the locking pin. In some embodiments, the opening may extend along a length of the channel wall.

As shown in FIG. 1 and FIGS. 5A-5B, the lock may be located at or near a distal portion 105*a* of the handle 102. In some embodiments, like the handle, the lock also may be graspable by the user to use the hose accessory and adjust the length of the hose accessory. As shown in FIG. 1, the lock may include an actuator 130 which may be depressed to disengage the lock and permit adjustment of the overall length of the hose accessory. For example, as shown in FIG. 5B, when the user presses the actuator 130 (see arrow P), the locking pin may be retracted from the opening 126 in the shaft. Next, while grasping at least a portion of the shaft, such as the first connector 106, the shaft may be moved towards or away from the handle to adjust the overall length of the hose accessory (see arrow A). For example, the shaft may be moved away from the handle to lengthen the hose accessory, or the shaft may be moved towards the handle to shorten the hose accessory. Once the hose accessory is adjusted to the desired length, the actuator may be released to allow the locking pin to engage with an opening in the shaft associated with the adjusted length, thereby locking the position of the shaft relative to the position of the handle.

As will be appreciated, the locking pin may engaged with different openings on the shaft depending on the desired overall length of the hose accessory. For example, the locking pin may engage with an opening near a distal portion of the shaft in embodiments in which a shorter hose accessory is desired. In a similar manner, the locking pin may engage with an opening near a proximal portion of the shaft in embodiments in which a longer hose accessory is desired. In such embodiments, when the locking pin is in the locked position, the locking pin may be received by the first channel, with the inner conduit being located in the second channel and isolated from the locking pin.

In some embodiments, the length of the hose accessory may be increased from between about 30-39 inches in a shortened position to between about 55-70 inches in a fully extended position. As will be appreciated the hose accessory may have other length in the shortened and extended positions as this aspect of the disclosure is not limited in this respect.

As will be appreciated, the hose accessory may be formed of any suitable material. For example, the handle and shaft may be formed of a rigid material such plastic or metal. In some embodiments, the handle and shaft are formed of an aluminum or an aluminum alloy. As will be appreciated, the shaft and handle may be formed of the same materials or of different materials. In some embodiments, the handle may be coated with a foam material, or may be surrounded a foam sleeve, to make gripping the handle easier.

In some embodiments, a water brush hose accessory is disclosed. In such embodiments, the wash brush hose accessory includes a handle, a shaft slidable relative to a handle, a flexible conduit extending through the handle of the water brush, and a brush head attached at a distal end of the shaft. In some embodiments, the proximal end of the water brush hose accessory is attachable to a hose to supply water to the hose accessory. In such embodiments, the water may travel through the flexible inner conduit of the water brush hose accessory, thereby distributing water to the brush head for cleaning a surface, such as a car.

According to another embodiment, a method of adjusting the length of the hose accessory is disclosed. In some embodiments, the method includes grasping a portion of the shaft and handle and slidably moving the shaft and handle relative to each other to adjust the accessory to a desired length. In some embodiments, the method includes engaging one of the plurality of openings formed in the wall of the shaft with a locking pin of the lock to secure the shaft relative to the handle at the desired location. In such embodiments, at least a portion of the locking pin is received in the first channel when the lock is in the locked position, with the inner conduit being located in the second channel.

According to another embodiment, a method of using the hose accessory is described. In some embodiments, the method may include attaching a cleaning head to a distal end of the shaft of the hose accessory. The method also may include slidably moving the shaft and handle relative to each other to adjust the length of the hose accessory. In some embodiments, the method may include engaging one of the plurality of openings formed in the wall of the shaft with the locking pin to secure the shaft relative to the handle to adjust the accessory to the desired length. As with other embodiments, at least a part of the locking pin is received in a first channel of the shaft when the locking pin is in the locked position. In some embodiments, the cleaning head may be removed and a second cleaning head may be attached. The length of the accessory may thereafter be adjusted to accommodate the second cleaning head.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A hose accessory comprising:

a handle;

a shaft slidably received in the handle, the shaft having first and second channels extending a long at least a portion of a length of the shaft;

a flexible conduit located within the handle and shaft, the conduit adapted to carry fluid between a first end of the hose accessory and a second end of the hose accessory; and a lock adapted to secure the shaft in a fixed position relative to the handle, the lock including a moveable pin biased towards a locked position, wherein the first channel is adapted to receive at least a portion of the moveable pin when the moveable pin is in the locked position.

2. The hose accessory of claim 1, wherein the first channel extends along an entire length of the shaft.

3. The hose accessory of claim 2, wherein the second channel extends along an entire length of the shaft.

4. The hose accessory of claim 1, wherein the first channel extends inwardly towards a center of the shaft.

5. The hose accessory of claim 1, wherein the first channel includes a substantially semicircular cross-sectional shape.

6. The hose accessory of claim 1, wherein the shaft includes a plurality of openings formed in a wall of the shaft.

7. The hose accessory of claim 6, wherein the plurality of openings are arranged along a length of the shaft.

8. The hose accessory of claim 6, wherein the locking pin is adapted to engage with one of the plurality of openings to secure the shaft in a fixed position relative to the handle.

9. The hose accessory of claim 6, wherein the plurality of openings are formed in a portion of the wall of the shaft that is opposite to the first channel.

10. The hose accessory of claim 9, wherein the plurality of openings are in communication with the first channel.

11. The hose accessory of claim 1, wherein the locking pin is spring biased towards the locked position.

12. The hose accessory of claim 1, further comprising a first connector located at a first end of the hose accessory, the first connector adapted to attach a cleaning head to the hose accessory, wherein the cleaning head includes at least one of a sprayer, mop head, brush, or wand.

13. The hose accessory of claim 12, wherein the cleaning head is fluidly coupled to the flexible conduit.

14. The hose accessory of claim 12, further comprising a second connector located at second end of the hose accessory, the second connector adapted to attach a fluid supply to the hose accessory.

15. A method of adjusting a length of a hose accessory having a handle, a shaft slidably received in the handle, and a flexible conduit located within the shaft and handle, the flexible conduit configured to carry fluid from a proximal end of the hose accessory to a distal end of the hose accessory, the method comprising:

slidably moving the shaft and handle relative to each other to adjust the accessory to a desired length, wherein the shaft includes first and second channels and a plurality of openings formed in a wall of the shaft, the plurality of openings being in communication with the first channel, engaging one of the plurality of openings with a locking pin to secure the shaft in a fixed position relative to the handle at the desired length, the at least a portion of the locking pin extending into the first channel when the locking pin is engaged with the one of the plurality of openings.

16. The method of claim 15, wherein the flexible conduit is located within the second channel of the shaft.

17. The method of claim 15, wherein the locking pin is disposed on the handle.

18. The method of claim 17, wherein the locking pin is disposed at a distal end of the handle.

19. The method of claim 15, wherein slidably moving the shaft and handle relative to each other includes extending the shaft from the handle.

20. A water brush hose accessory comprising:

a handle;

a shaft slidably received in the handle, the shaft having first and second channels extending a long at least a portion of a length of the shaft;

a cleaning head located at a distal end of the shaft;

a flexible conduit located within the handle and shaft, the conduit adapted to carry fluid between a proximal end of the hose accessory and the cleaning head; and a locking pin adapted to secure the shaft in a fixed position relative to the handle, wherein the locking pin is biased towards a locked position, wherein the first channel is adapted to receive at least a portion of the locking pin when the locking pin is in the locked position.

* * * * *